US010014613B2

(12) United States Patent
Cheney et al.

(10) Patent No.: US 10,014,613 B2
(45) Date of Patent: Jul. 3, 2018

(54) POTTING COMPOUND CHAMBER DESIGNS FOR ELECTRICAL CONNECTORS

(71) Applicants: Eric Perry Cheney, Marcellus, NY (US); Jesse Wade Taylor, Baldwinsville, NY (US); Adam Douglas Ledgerwood, Syracuse, NY (US)

(72) Inventors: Eric Perry Cheney, Marcellus, NY (US); Jesse Wade Taylor, Baldwinsville, NY (US); Adam Douglas Ledgerwood, Syracuse, NY (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/342,556

(22) Filed: Nov. 3, 2016

(65) Prior Publication Data

US 2017/0133782 A1 May 11, 2017

Related U.S. Application Data

(60) Provisional application No. 62/251,758, filed on Nov. 6, 2015.

(51) Int. Cl.
*H01R 13/405* (2006.01)

(52) U.S. Cl.
CPC ..... *H01R 13/405* (2013.01)

(58) Field of Classification Search
CPC ..... H01R 13/05
USPC ..... 439/736
See application file for complete search history.

(56) References Cited

U.S. PATENT DOCUMENTS

| | | | | |
|---|---|---|---|---|
| 3,585,563 | A | 6/1971 | Hegle | |
| 3,739,128 | A | 6/1973 | Kaesser et al. | |
| 3,761,601 | A | 9/1973 | Kaesser et al. | |
| 4,314,094 | A | 2/1982 | Smith | |
| 4,335,932 | A | 6/1982 | Herrmann, Jr. | |
| 4,629,269 | A * | 12/1986 | Kailus | H01R 13/5221 439/587 |

(Continued)

OTHER PUBLICATIONS

O. Tsykanovskaya, International Search Report and Written Opinion issued in International Patent Application No. PCT/US2016/060294, completion date Jan. 26, 2017, dated Feb. 2, 2017, 6 pages, Federal Institute of Industrial Property, Moscow, Russia.

*Primary Examiner* — Alexander Gilman
(74) *Attorney, Agent, or Firm* — King & Spalding LLP

(57) ABSTRACT

An electrical chamber can include at least one wall forming a cavity, where the at least one wall includes a first end and a wall inner surface. The electrical chamber can also include a first isolation zone disposed on the inner surface at a first distance from the first end, where the first isolation zone is formed by a first proximal wall, a first distal wall, and a first isolation zone inner surface disposed between and adjacent to the first proximal wall and the first distal wall, where the first proximal wall forms a first angle with the first isolation zone inner surface, where the first distal wall forms a second angle with the first isolation zone inner surface, where the first angle is non-perpendicular. The cavity is configured to receive at least one electrical conductor. The cavity and the first isolation zone are configured to receive a potting compound.

20 Claims, 10 Drawing Sheets

(56) References Cited

U.S. PATENT DOCUMENTS 4,795,372 A 1/1989 Kobler
4,893,215 A 1/1990 Urushiwara et al.
5,194,021 A * 3/1993 Oba ..... H01R 13/5216 439/589
5,387,129 A * 2/1995 Hotea ..... H01R 13/5205 439/276
5,645,451 A 7/1997 Ohsumi et al.
6,142,805 A * 11/2000 Gray ..... H01R 13/5221 439/135
6,193,536 B1 2/2001 Sanuki
6,623,289 B2 * 9/2003 Decicco ..... H01R 13/527 439/271
6,722,706 B2 * 4/2004 Church ..... E21B 17/042 285/333
6,818,829 B1 * 11/2004 McMillan ..... H02G 15/076 174/74 R
6,964,575 B1 11/2005 Sailor
7,014,502 B2 3/2006 Rasmussen
7,118,646 B2 10/2006 Hunkeler
7,238,036 B2 7/2007 Sato et al.
7,240,925 B2 * 7/2007 Fukano ..... F16L 47/04 285/243
7,326,015 B2 * 2/2008 Reynolds, Jr. ..... F16B 33/004 411/424
7,445,481 B2 * 11/2008 Nagashima ..... H01R 13/521 439/276
7,821,791 B2 10/2010 Popp et al.
8,029,026 B2 * 10/2011 Stolle ..... E21B 17/0426 285/330
8,357,854 B2 * 1/2013 Thompson ..... B29C 45/44 174/77 R
8,657,609 B2 2/2014 Yanagisawa et al.
8,814,606 B2 * 8/2014 Endo ..... H01R 13/405 439/736
9,017,088 B2 * 4/2015 Endo ..... H01R 9/00 439/276
9,368,905 B2 * 6/2016 Ledgerwood ..... H01R 13/5216
9,577,368 B2 * 2/2017 Fukuda ..... H01R 13/03
2006/0286845 A1 12/2006 Hinze
2007/0212918 A1 9/2007 Gruebel et al.
2009/0057006 A1 3/2009 Kishibata et al.
2009/0145656 A1 6/2009 Tschudin
2009/0173393 A1 * 7/2009 Grabert ..... F16K 17/162 137/68.23
2012/0236479 A1 9/2012 Tamai et al.
2013/0223037 A1 8/2013 Mikami
2013/0224979 A1 * 8/2013 Sato ..... H01R 13/5202 439/271
2014/0076772 A1 3/2014 Azumi et al.
2014/0235088 A1 8/2014 Fawcett
2014/0329399 A1 11/2014 Ohsumi et al.
2015/0171543 A1 * 6/2015 Sittner ..... H01R 13/405 439/271
2016/0281440 A1 * 9/2016 Sugino ..... E21B 17/042
2017/0059063 A1 * 3/2017 Perron ..... E21B 17/043

* cited by examiner

POTTING COMPOUND CHAMBER DESIGNS FOR ELECTRICAL CONNECTORS

CROSS-REFERENCE TO RELATED APPLICATIONS

This application claims priority under 35 U.S.C. § 119 to U.S. Provisional Patent Application Ser. No. 62/251,758, titled "Potting Compound Chamber Designs For Electrical Connectors" and filed on Nov. 6, 2015, the entire contents of which are hereby incorporated herein by reference.

TECHNICAL FIELD

Embodiments of the invention relate generally to electrical connectors, and more particularly to systems, methods, and devices for potting compound chamber designs for electrical connectors.

BACKGROUND

Electrical connectors known in the art are configured to couple to a single device or a number of devices having the same voltage and/or current requirements. In some cases, a potting compound is used to fill at least a portion of a chamber within an electrical connector. The potting compound can serve one or more of a number of purposes, including but not limited to providing electrical isolation of one or more components within the chamber and providing a barrier to prevent fluids from traversing through the chamber. As another example, the potting compound can be used to withstand extreme service temperatures over a long service life (accelerated in test by higher temperatures) while preventing the passage of hazardous gas and flame therethrough. The potting compound can be designed to serve these purposes within the chamber under a certain amount of pressure. In many cases, the coefficient of thermal expansion of a potting compound differs from the coefficient of thermal expansion of the electrical connector inside of which the potting compound is disposed.

SUMMARY

In general, in one aspect, the disclosure relates to an electrical chamber that includes at least one wall forming a cavity, where the at least one wall includes a first end and a wall inner surface. The electrical chamber can also include a first isolation zone disposed on the wall inner surface at a first distance from the first end, where the first isolation zone is formed by a first proximal wall, a first distal wall, and a first isolation zone inner surface disposed between and adjacent to the first proximal wall and the first distal wall, where the first proximal wall forms a first angle with the first isolation zone inner surface, where the first distal wall forms a second angle with the first isolation zone inner surface, where the first angle is non-perpendicular. The cavity can be configured to receive at least one electrical conductor. The cavity and the first isolation zone can be configured to receive a potting compound.

In another aspect, the disclosure can generally relate to an electrical connector that includes an electrical chamber the includes at least one wall forming a cavity, where the at least one wall includes a first end and a wall inner surface. The electrical chamber of the electrical connector can also include a first isolation zone disposed on the wall inner surface at a first distance from the first end, where the first isolation zone is formed by a first proximal wall, a first distal wall, and a first isolation zone inner surface disposed in between and adjacent to the first proximal wall and the first distal wall, where the first proximal wall forms a first angle with the first isolation zone inner surface, where the first distal wall forms a second angle with the first isolation zone inner surface, where the first angle is non-perpendicular. The electrical connector can also include at least one electrical conductor disposed within the cavity. The electrical connector can further include a potting compound disposed around the at least one conductor within the cavity and the first isolation zone.

These and other aspects, objects, features, and embodiments will be apparent from the following description and the appended claims.

BRIEF DESCRIPTION OF THE DRAWINGS

The drawings illustrate only example embodiments of potting compound chamber designs for electrical connectors and are therefore not to be considered limiting of its scope, as potting compound chamber designs for electrical connectors may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
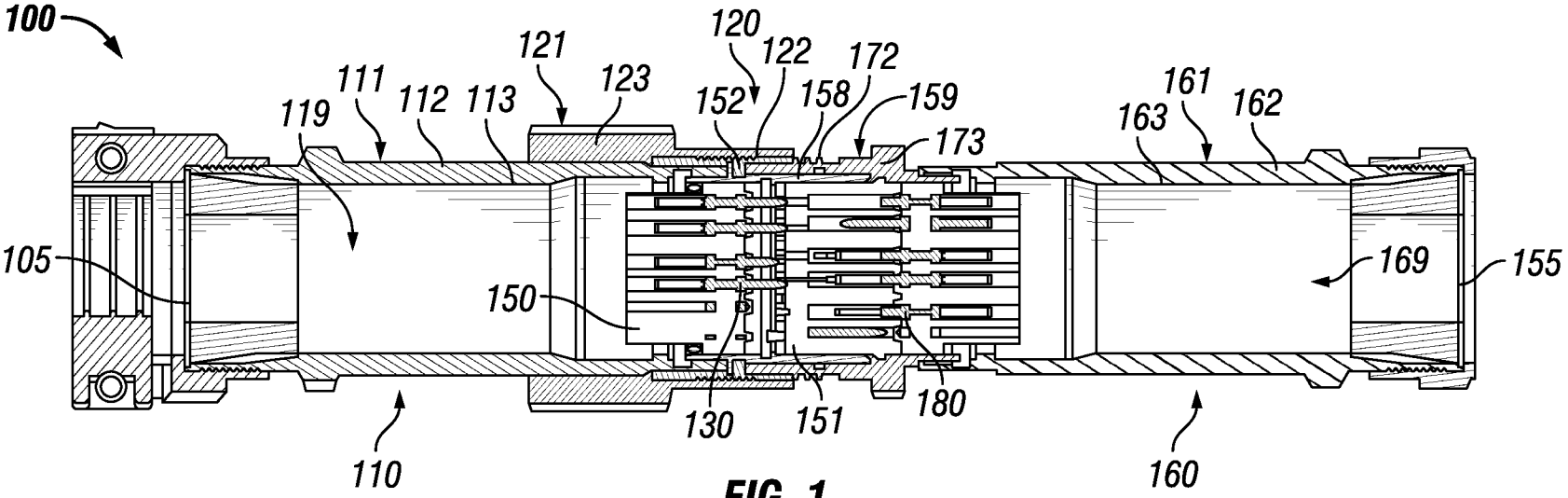
FIG. 1 (Prior Art)
FIG. 1 shows an electrical connector currently known in the art.

The example embodiments discussed herein are directed to systems, apparatuses, and methods of potting compound chamber designs for electrical connectors. While the example potting compound chamber designs for electrical connectors shown in the Figures and described herein are directed to electrical connectors, example potting compound chamber designs for electrical connectors can also be used with other devices aside from electrical connectors, including but not limited to instrumentation devices, electronics devices, light fixtures, hazardous area sealing fittings, lighting for restricted breathing, control devices, and load cells. Thus, the examples of potting compound chamber designs for electrical connectors described herein are not limited to use with electrical connectors. An example electrical connector can include an electrical connector end that is coupled to a complementary electrical connector end.

Any example electrical connector, or portions (e.g., features) thereof, described herein can be made from a single piece (as from a mold). When an example electrical connector or portion thereof is made from a single piece, the single piece can be cut out, bent, stamped, and/or otherwise shaped to create certain features, elements, or other portions of a component. Alternatively, an example electrical connector (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, fasten, and/or perform other functions aside from merely coupling. In addition, each component and/or feature described herein can be made of one or more of a number of suitable materials, including but not limited to metal, rubber, ceramic, silicone, and plastic.

A coupling feature (including a complementary coupling feature) as described herein can allow one or more components and/or portions of an electrical connector (e.g., a first connector end) to become mechanically and/or electrically coupled, directly or indirectly, to another portion (e.g., a second connector end) of the electrical connector. A coupling feature can include, but is not limited to, a conductor, a conductor receiver, portion of a hinge, an aperture, a recessed area, a protrusion, a slot, a spring clip, a tab, a detent, and mating threads. One portion of an example electrical connector can be coupled to another portion of an electrical connector by the direct use of one or more coupling features.

In addition, or in the alternative, a portion of an example electrical connector (e.g., an electrical connector end) can be coupled to another portion of the electrical connector (e.g., a complementary electrical connector end) using one or more independent devices that interact with one or more coupling features disposed on a component of the electrical connector. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

As defined herein, an electrical connector for which example potting compound chamber designs are used can be any type of connector end, enclosure, plug, or other device used for the connection and/or facilitation of one or more electrical conductors carrying electrical power and/or control signals. As described herein, a user can be any person that interacts with example potting compound chamber designs for electrical connectors or a portion thereof. Examples of a user may include, but are not limited to, an engineer, an electrician, a maintenance technician, a mechanic, an operator, a consultant, a contractor, a homeowner, and a manufacturer's representative.

The potting compound chamber designs for electrical connectors described herein, while within their enclosures, can be placed in outdoor environments. In addition, or in the alternative, example potting compound chamber designs for electrical connectors can be subject to extreme heat, extreme cold, moisture, humidity, high winds, dust, chemical corrosion, and other conditions that can cause wear on the potting compound chamber designs for electrical connectors or portions thereof. In certain example embodiments, the potting compound chamber designs for electrical connectors, including any portions thereof, are made of materials that are designed to maintain a long-term useful life and to perform when required without mechanical failure.

In addition, or in the alternative, example potting compound chamber designs for electrical connectors can be located in hazardous and/or explosion-proof environments. In the latter case, the electrical connector (or other enclosure) in which example potting compound chamber designs for electrical connectors are disposed can be integrated with an explosion-proof enclosure (also known as a flame-proof enclosure). An explosion-proof enclosure is an enclosure that is configured to contain an explosion that originates inside, or can propagate through, the enclosure. Further, the explosion-proof enclosure is configured to allow gases from inside the enclosure to escape across joints of the enclosure and cool as the gases exit the explosion-proof enclosure.

The joints are also known as flame paths and exist where two surfaces (which may include one or more parts of an electrical connector in which example in-line potting compounds are disposed) meet and provide a path, from inside the explosion-proof enclosure to outside the explosion-proof enclosure, along which one or more gases may travel. A joint may be a mating of any two or more surfaces. Each surface may be any type of surface, including but not limited to a flat surface, a threaded surface, and a serrated surface. By definition the potting compound used in example embodiments eliminates any potential flame-path it contacts by virtue of the testing requirements. Other flame-paths may still exist within the electrical connector. In other words, the potting compound can create a flameproof barrier and/or a flame path.

As the size of an electrical connector increases and/or as the temperatures to which an electrical connector is exposed over time fluctuate, the potting compound can separate from the inner wall of the electrical connector. In turn, the flameproof barrier created by the potting compound can be compromised. Example embodiments help ensure that the integrity of the flameproof barrier created by the potting compound with the inner surfaces of the electrical connector is maintained, regardless of the size of the electrical connector and/or the range of temperatures to which the electrical connector is exposed.

In one or more example embodiments, an explosion-proof enclosure is subject to meeting certain standards and/or requirements. For example, the National Electrical Manufacturers Association (NEMA) sets standards with which an enclosure must comply in order to qualify as an explosion-proof enclosure. Specifically, NEMA Type 7, Type 8, Type 9, and Type 10 enclosures set standards with which an explosion-proof enclosure within a hazardous location must comply. For example, a NEMA Type 7 standard applies to enclosures constructed for indoor use in certain hazardous locations. Hazardous locations may be defined by one or more of a number of authorities, including but not limited to the National Electric Code (e.g., Class 1, Division I) and Underwriters' Laboratories, Inc. (UL) (e.g., UL 1203). For example, a Class 1 hazardous area under the National Electric Code is an area in which flammable gases or vapors may be present in the air in sufficient quantities to be explosive.

Examples of a hazardous location in which example embodiments can be used can include, but are not limited to, an airplane hanger, an airplane, a drilling rig (as for oil, gas, or water), a production rig (as for oil or gas), a refinery, a chemical plant, a power plant, a mining operation, and a steel mill. For the purposes of clarity, an angle that is described herein as 90° can be referred to as normal or perpendicular. An angle that is between 0° and 90° can be referred herein to as an acute angle. An angle that is between 90° and 180° can be referred herein to as an obtuse angle. An angle that is acute or obtuse can also be referred to herein as non-normal or non-perpendicular.

As another example, Directive 94/9/EC of the European Union, entitled (in French) Appareils destinés à être utilisés en Atmospheres Explosibles (ATEX), sets standards for equipment and protective systems intended for use in potentially explosive environments. Specifically, ATEX 95 sets forth a minimum amount of shear strength that an electrical connector must be able to withstand. As yet another example, the International Electrotechnical Commission (IEC) develops and maintains the IECEx, which is the IEC system for certification to standards relating to equipment for use in explosive atmospheres. IECEx uses quality assessment specifications that are based on International Standards prepared by the IEC.

As a specific example, a potting compound within an electrical connector may be required to prevent gas and/or liquid from leaking through the electrical connector while under a pressure (also called a reference pressure) that is at least four times the expected pressure at which the electrical connector is rated to explode ruptures (e.g., explodes). In testing, example electrical connectors having potting compound disposed therein can be tested for liquid leakage at high pressures to simulate whether gases may leak during normal operating conditions. In such a case, an applicable standard is ATEX/IECEx Standard 60079-1.

In the foregoing figures showing example embodiments of potting compound chamber designs for electrical connectors, one or more of the components shown may be omitted, repeated, and/or substituted. Accordingly, example embodiments of potting compound chamber designs for electrical connectors should not be considered limited to the specific arrangements of components shown in any of the figures. For example, features shown in one or more figures or described with respect to one embodiment can be applied to another embodiment associated with a different figure or description.

Any component described in a figure herein can apply to a corresponding component having a similar label in another figure herein. In other words, the description for any component of a figure can be considered substantially the same as the corresponding component shown with respect to another figure. Further, if a component of a figure is described but not expressly shown or labeled in that figure, a corresponding component shown and/or labeled in another figure can be used to infer a description and/or label for that figure. The numbering scheme for the figures is such that each individual component is a three or four digit number having the identical last two digits when that component appears in multiple figures.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of potting compound chamber designs for electrical connectors will be described more fully hereinafter with reference to the accompanying drawings, in which example embodiments of potting compound chamber designs for electrical connectors are shown. Potting compound chamber designs for electrical connectors may, however, be embodied in many different forms and should not be construed as limited to the example embodiments set forth herein. Rather, these example embodiments are provided so that this disclosure will be thorough and complete, and will fully convey the scope of potting compound chamber designs for electrical connectors to those of ordinary skill in the art. Like, but not necessarily the same, elements (also sometimes called modules) in the various figures are denoted by like reference numerals for consistency.

Terms such as "first", "second", "end", "inner", "distal", and "proximal" are used merely to distinguish one component (or part of a component or state of a component) from another. Such terms are not meant to denote a preference or a particular orientation. Also, the names given to various components described herein are descriptive of example embodiments and are not meant to be limiting in any way. Those skilled in the art will appreciate that a feature and/or component shown and/or described in one embodiment (e.g., in a figure) herein can be used in another embodiment (e.g., in any other figure) herein, even if not expressly shown and/or described in such other embodiment.

FIG. 1 shows an electrical connector 100 currently known in the art. The electrical connector 100 can have a first end 110 and a second end 160 that are coupled to each other. The electrical connector end 110 can include a shell 111, an insert 150, a number of electrical coupling features 130, and a coupling sleeve 121. The shell 111 (also generally referred to as an electrical chamber 111) can include at least one wall 112 that forms a cavity 119. The shell 111 can be used to house some or all of the other components (e.g., the insert 150, the electrical coupling features 130) of the electrical connector end 110 within the cavity 119. The shell 111 can include one or more of a number of coupling features (e.g., slots, detents, protrusions) that can be used to connect the shell 111 to some other component (e.g., the shell 161 of a complementary electrical connector end 160) of an electrical connector and/or to an enclosure (e.g., a junction box, a panel). The shell 111 can be made of one or more of a number of materials, including but not limited to metal and plastic. The shell 111 can be made of one or more of a number of electrically conductive materials and/or electrically non-conductive materials. The shell 111 can include an extension 158 that couples to a portion (e.g., the body 173) of a complementary coupling sleeve (e.g., coupling sleeve 159). Also, the shell 111 can have an end 105 that is opposite the end in which the insert 150 is disposed.

The insert 150 can be disposed within the cavity 119 of the shell 111. One or more portions of the insert 150 can have one or more of a number of coupling features. Such coupling features can be used to couple and/or align the insert 150 with one or more other components (e.g., the inner surface 113 of the shell 111) of the electrical connector end 110. As an example, a recessed area (e.g., a notch, a slot)

can be disposed in the outer perimeter of the insert 150. In such a case, each coupling feature can be used with a complementary coupling feature (e.g., a protrusion) disposed on the shell 111 to align the insert 150 with and/or mechanically couple the insert 150 to the shell 111.

The insert 150 can include one or more apertures that traverse through some or all of the insert 150. For example, there can be one or more apertures (hidden from view by the electrical coupling features 130, described below) disposed in various locations of the insert 150. In such a case, if there are multiple apertures, such apertures can be spaced in any of a number of ways and locations relative to each other. In certain example embodiments, one or more of the apertures can have an outer perimeter that is larger than the outer perimeter of the electrical coupling features 130. In such a case, there can be a gap between an electrical coupling feature 130 and the insert 150.

The one or more apertures for the electrical coupling features 130 can be pre-formed when the insert 150 is created. In such a case, the electrical coupling features 130 can be post-inserted into the respective apertures of the insert 150. Alternatively, the insert 150 can be overmolded around the electrical coupling features 130. The insert 150 can be made of one or more of a number of materials, including but not limited to plastic, rubber, and ceramic. Such materials can be electrically conductive and/or electrically non-conductive.

The one or more electrical coupling features 130 can be made of one or more of a number of electrically conductive materials. Such materials can include, but are not limited to, copper and aluminum. Each electrical coupling feature 130 is configured to mechanically and electrically couple to, at one (e.g., distal) end (hidden from view), one or more electrical conductors, and to mechanically and electrically couple to, at the opposite (e.g., proximal) end, another portion (e.g., complementary electrical coupling features) of an electrical connector. Any of a number of configurations for the proximal end and the distal end of an electrical coupling feature 130 can exist and are known to those of ordinary skill in the art. The configuration of the proximal end and/or the distal end of one electrical coupling feature 130 of the electrical connector end 110 can be the same as or different than the configuration of the proximal end and/or the distal end of the remainder of electrical coupling features 130 of the electrical connector end 110.

The electrical coupling features 130 can take on one or more of a number of forms, shapes, and/or sizes. Each of the electrical coupling features 130 in this case is shown to have substantially the same shape and size as the other electrical coupling features 130. In certain example embodiments, the shape and/or size of one electrical coupling feature 130 of an electrical connector end 110 can vary from the shape and/or size of one or more other electrical coupling features 130. This may occur, for example if varying amounts and/or types of current and/or voltage are delivered between the electrical coupling features 130.

One or more electrical cables (not shown) can be disposed within the cavity 119. Each electrical cable can have one or more electrical conductors made of one or more of a number of electrically conductive materials (e.g., copper, aluminum). Each conductor can be coated with one or more of a number of electrically non-conductive materials (e.g., rubber, nylon). Similarly, an electrical cable having multiple conductors can be covered with one or more of a number of electrically non-conductive materials. Each conductor of an electrical cable disposed within the cavity 119 can be electrically and mechanically coupled to an electrical coupling feature 130.

The coupling sleeve 121 can be disposed over a portion of the shell 111 and can include one or more coupling features 122 (e.g., mating threads) disposed on the body 123 of the coupling sleeve 121. The coupling sleeve 121, along with the coupling sleeve 159 of the electrical connector end 160, can make up the electrical connector coupling mechanism 120. The coupling features 122 of the coupling sleeve 121 complement the coupling features 172 of the coupling sleeve 159 of the electrical connector end 160.

The electrical connector end 160 can include a shell 161, an insert 151, a number of electrical coupling features 180, and a coupling sleeve 159. The shell 161 can include at least one wall 162 that forms a cavity 169. The shell 161 can be used to house some or all of the other components (e.g., the insert 151, the electrical coupling features 180) of the electrical connector end 160 within the cavity 169. The shell 161 can include one or more of a number of coupling features (e.g., slots, detents, protrusions) that can be used to connect the shell 161 to some other component (e.g., the shell 111 of the complementary electrical connector end 110) of an electrical connector and/or to an enclosure (e.g., a junction box, a panel). The shell 161 can be made of one or more of a number of materials, including but not limited to metal and plastic. The shell 161 can be made of one or more of a number of electrically conductive materials and/or electrically non-conductive materials. Also, the shell 161 can have an end 155 that is opposite the end in which the insert 151 is disposed.

The insert 151 can be disposed within the cavity 169 of the shell 161. One or more portions of the insert 151 can have one or more of a number of coupling features. Such coupling features can be used to couple and/or align the insert 151 with one or more other components (e.g., the inner surface 163 of the shell 161) of the electrical connector end 160. As an example, a recessed area (e.g., a notch, a slot) can be disposed in the outer perimeter of the insert 151. In such a case, each coupling feature can be used with a complementary coupling feature (e.g., a protrusion) disposed on the shell 161 to align the insert 151 with and/or mechanically couple the insert 151 to the shell 161.

The insert 151 can include one or more apertures that traverse through some or all of the insert 151. For example, there can be one or more apertures (hidden from view by the electrical coupling features 180, described below) disposed in various locations of the insert 151. In such a case, if there are multiple apertures, such apertures can be spaced in any of a number of ways and locations relative to each other. In certain example embodiments, one or more of the apertures can have an outer perimeter that is larger than the outer perimeter of the electrical coupling features 180. In such a case, there can be a gap between an electrical coupling feature 180 and the insert 151.

The one or more apertures for the electrical coupling features 180 can be pre-formed when the insert 151 is created. In such a case, the electrical coupling features 180 can be post-inserted into the respective apertures of the insert 151. Alternatively, the insert 151 can be overmolded around the electrical coupling features 180. The insert 151 can be made of one or more of a number of materials, including but not limited to plastic, rubber, and ceramic. Such materials can be electrically conductive and/or electrically non-conductive.

The one or more electrical coupling features 180 can be made of one or more of a number of electrically conductive materials. Such materials can include, but are not limited to, copper and aluminum. Each electrical coupling feature 180 is configured to mechanically and electrically couple to, at one (e.g., distal) end (hidden from view), one or more electrical conductors, and to mechanically and electrically couple to, at the opposite (e.g., proximal) end, another portion (e.g., complementary electrical coupling features) of an electrical connector. Any of a number of configurations for the proximal end and the distal end of an electrical coupling feature 180 can exist and are known to those of ordinary skill in the art. The configuration of the proximal end and/or the distal end of one electrical coupling feature 180 of the electrical connector end 160 can be the same as or different than the configuration of the proximal end and/or the distal end of the remainder of electrical coupling features 180 of the electrical connector end 160.

The electrical coupling features 180 can take on one or more of a number of forms, shapes, and/or sizes. Each of the electrical coupling features 180 in this case is shown to have substantially the same shape and size as the other electrical coupling features 180. In certain example embodiments, the shape and/or size of one electrical coupling feature 180 of an electrical connector end 160 can vary from the shape and/or size of one or more other electrical coupling features 180. The shape, size, and configuration of the electrical coupling features 180 of the electrical connector end 160 can complement (be the mirror image of) the electrical coupling features 130 of the electrical connector end 110.

One or more electrical cables (not shown) can be disposed within the cavity 169. Such electrical cables are different from the electrical cables described above with respect to the electrical connector end 110, but can have similar characteristics (e.g., conductors, insulation, materials) as such cables. Each conductor of an electrical cable disposed within the cavity 169 can be electrically and mechanically coupled to an electrical coupling feature 180.

The coupling sleeve 159 of the electrical connector end 160 can be disposed over a portion of the shell 161 and can include one or more coupling features 172 (e.g., mating threads) disposed on the body 173 of the coupling sleeve 159. The coupling features 172 of the coupling sleeve 159 complement the coupling features 122 of the coupling sleeve 121 of the electrical connector end 110. One or more sealing devices (e.g., sealing device 152) can be used to provide a seal between the coupling sleeve 121 and the coupling sleeve 159.

Figure 2A:
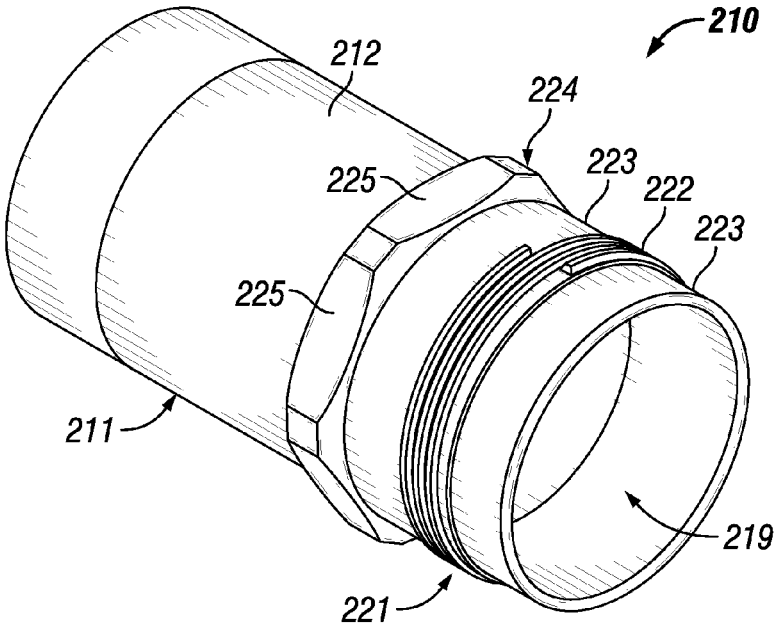
FIGS. 2A and 2B show external views an electrical connector end in accordance with certain example embodiments.
Figure 2B:
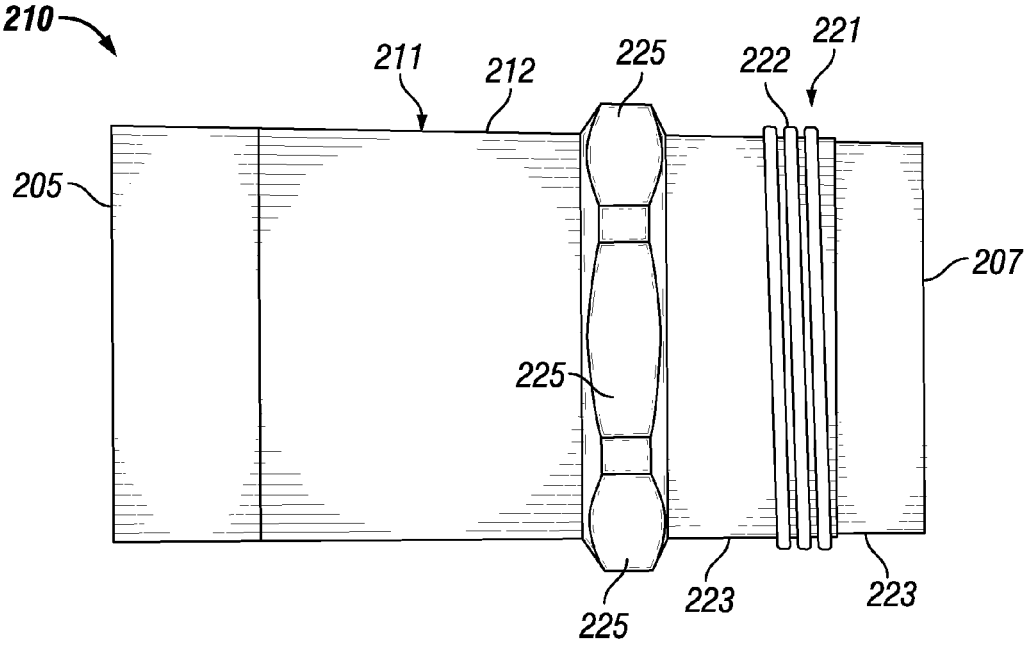

FIGS. 2A and 2B show various views of an electrical connector end 210 in accordance with certain example embodiments. Specifically, FIG. 2A shows a perspective view of the electrical connector end 210, and FIG. 2B shows a side view of the electrical connector end 210. Referring to FIGS. 1-2B, looking from the outside, the electrical connector end 210 having example embodiments is substantially indistinguishable from the first end 110 or the second end 160 of the electrical connector 100 of FIG. 1.

For example, the electrical connector end 210 of FIGS. 2A and 2B includes a shell 211 having at least one wall 212 that forms a cavity 219 that traverses the length of the electrical connector end 210. In this case, the shell 211 of the electrical connector end 210 is defined along its length by end 205 and end 207. The shell 211 can have any of a number of cross-sectional shapes when viewed from an end (e.g., end 205, end 207) along its length. Examples of such cross-sectional shapes can include, but are not limited to, circular (as in this case), oval, elliptical, square, triangular, and octagonal.

The shell 211 can also have a coupling sleeve 221 disposed over a portion (in this case, an end) of the shell 211 and can include one or more coupling features 222 (e.g., mating threads) disposed on the body 223 of the coupling sleeve 221. The electrical connector end 210 can further have coupling feature 224 disposed on the outer surface of the wall 212 of the shell 211. For example, in this case, the coupling feature 224 is a number (e.g., six) of flat surfaces 225 that extend away from the outer surface of the wall 212 of the shell 211. The flat surfaces 225 of the coupling feature 224 are configured to receive a wrench, pliers, or similar device that enables a user to axially rotate the electrical connector end 210 about its length.

Figure 3A:
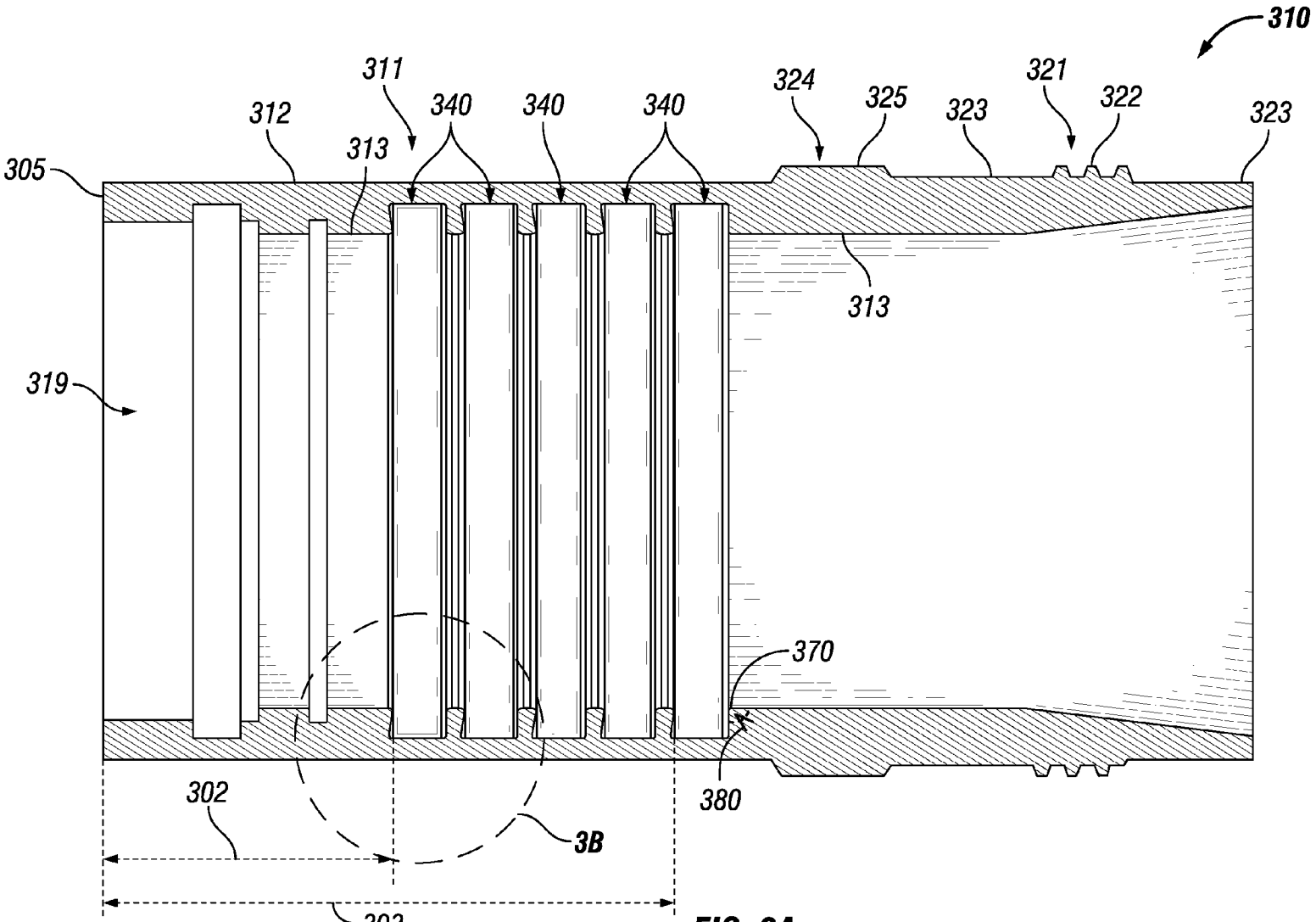
FIGS. 3A and 3B show details of an electrical connector end in accordance with certain example embodiments.
Figure 3B:
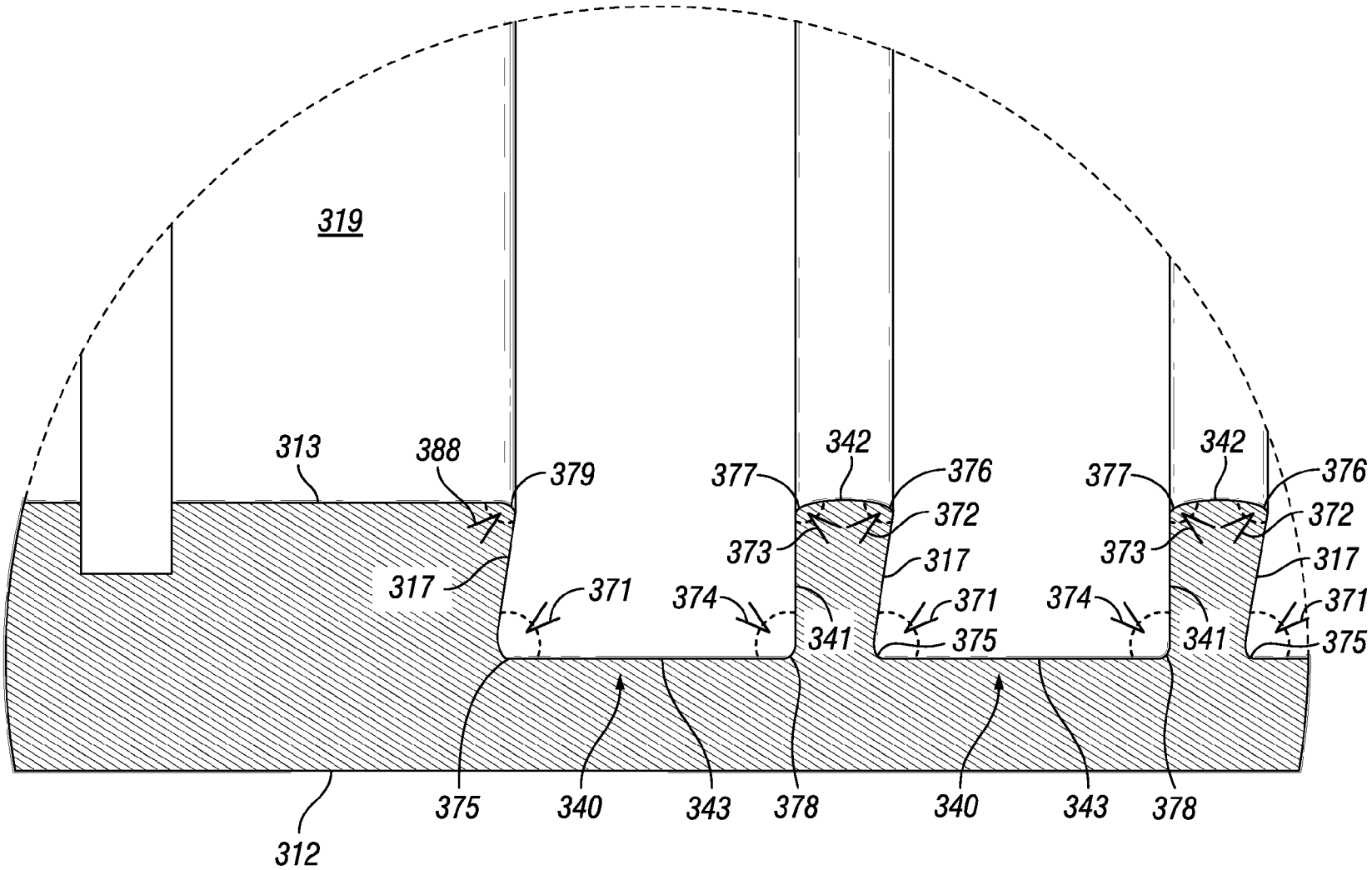

FIGS. 3A and 3B show various views of an electrical connector end 310 in accordance with certain example embodiments. Specifically, FIG. 3A shows a cross-sectional side view of the electrical connector end 310, and FIG. 3B shows a detailed view of an isolation zone 340 of the electrical connector end 310. Referring to FIGS. 1-3B, the electrical connector end 310 of FIGS. 3A and 3B is substantially similar to the electrical connector end 210 of FIGS. 2A and 2B, except as described below.

Example electrical connector ends discussed herein can include one or more of a number of isolation zones. For example, the electrical connector end 310 of FIGS. 3A and 3B includes five isolation zones 340 disposed inside the cavity 319 on the inner surface 313 of the wall 312 of the shell 311. In certain example embodiments, there can be any number (e.g., one, two, three, six) of example isolation zones 340 disposed on a shell (e.g., shell 311) of an electrical connector end (e.g., electrical connector end 310). When there are multiple isolation zones disposed on a shell, one isolation zone can have characteristics (e.g., size, shape, configuration) that are substantially the same as, or different than, corresponding characteristics of one or more of the other isolation zones. In this example, all of the isolation zones 340 disposed on the shell 311 have substantially the same characteristics relative to each other.

Each example isolation zone 340 can be located some distance from an end (e.g., end 305) of the shell (e.g., shell 311) on which the isolation zone is disposed. In this example, the isolation zone 340 most proximate to the end 305 of the of the shell 310 is disposed a distance 302 (e.g., approximately 1.42 inches) from the end 305, while the distal-most isolation zone 340 relative to the end 305 is disposed a distance 303 (e.g., approximately 2.63 inches) from the end 305, where distance 303 is greater than distance 302. In this case, each distance is measured to the part of the isolation zone 340 located closest to the end 305. In certain example embodiments, distance 302 and distance 303 are large enough to place the isolation zones 340 away from the end 305 so that the isolation zones 340 are not adjacent or proximate to the end 305.

Example isolation zones can have any of a number of configurations and/or features. In this example, each of the isolation zones 340 shown in FIGS. 3A and 3B is formed by a proximal wall 317, a distal wall 341, and an isolation zone inner surface 343. In certain example embodiments, an isolation zone 340 can be disposed continuously around all of the inner surface 313 at the distance (e.g., distance 302, distance 303) from the end (e.g., end 305). Alternatively, an isolation zone 340 can be disposed in discrete segments around one or more portions of the inner surface 313 at the distance from the end 305. In certain example embodiments, the isolation zones disposed on an inner surface of a shell are located on a different part of the inner surface of that shell compared to where the insert is located. In some cases, one or more isolation zones are located on an inner surface 313 of a the body 323 of the coupling sleeve 321 of the electrical connector end 310.

Figure 8:
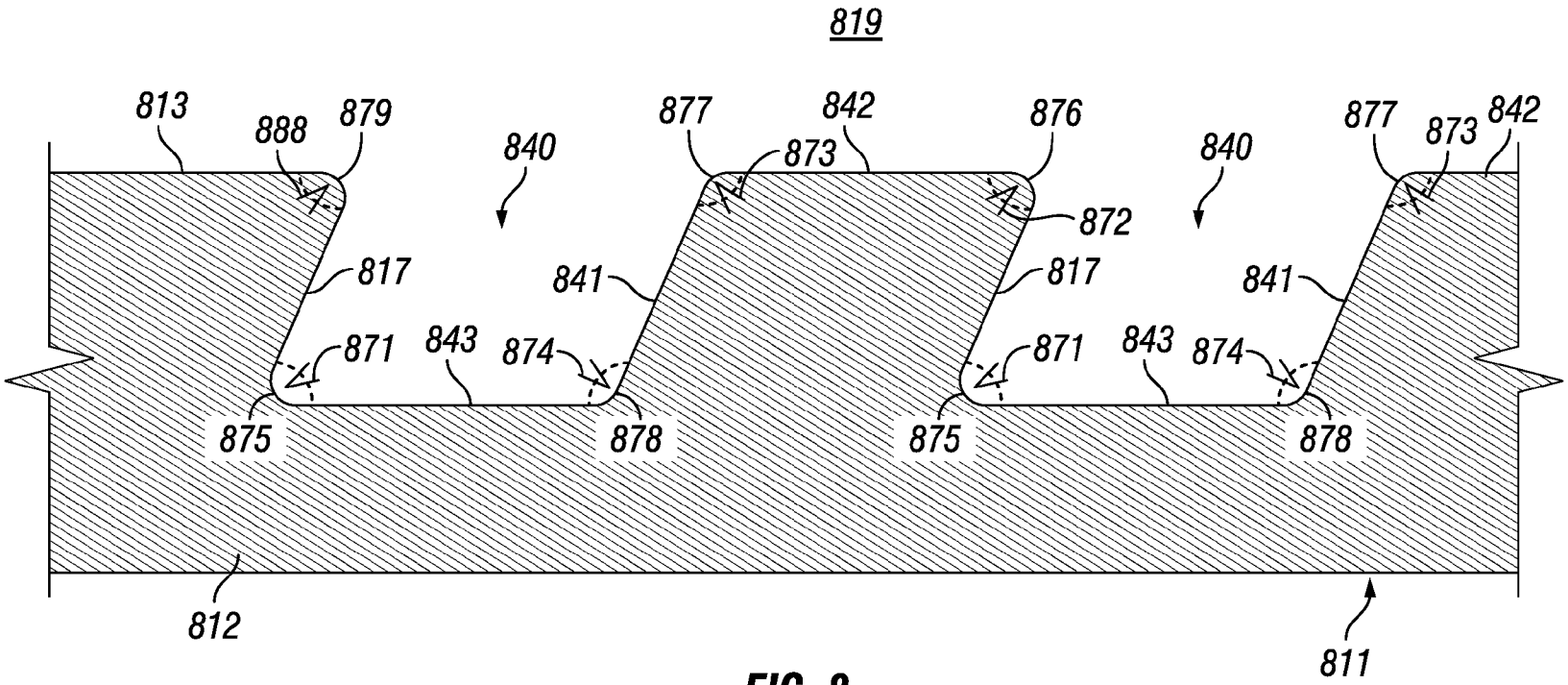
FIGS. 8 and 9 show detailed views of various isolation zones of electrical connector ends in accordance with certain example embodiments.
Figure 9:
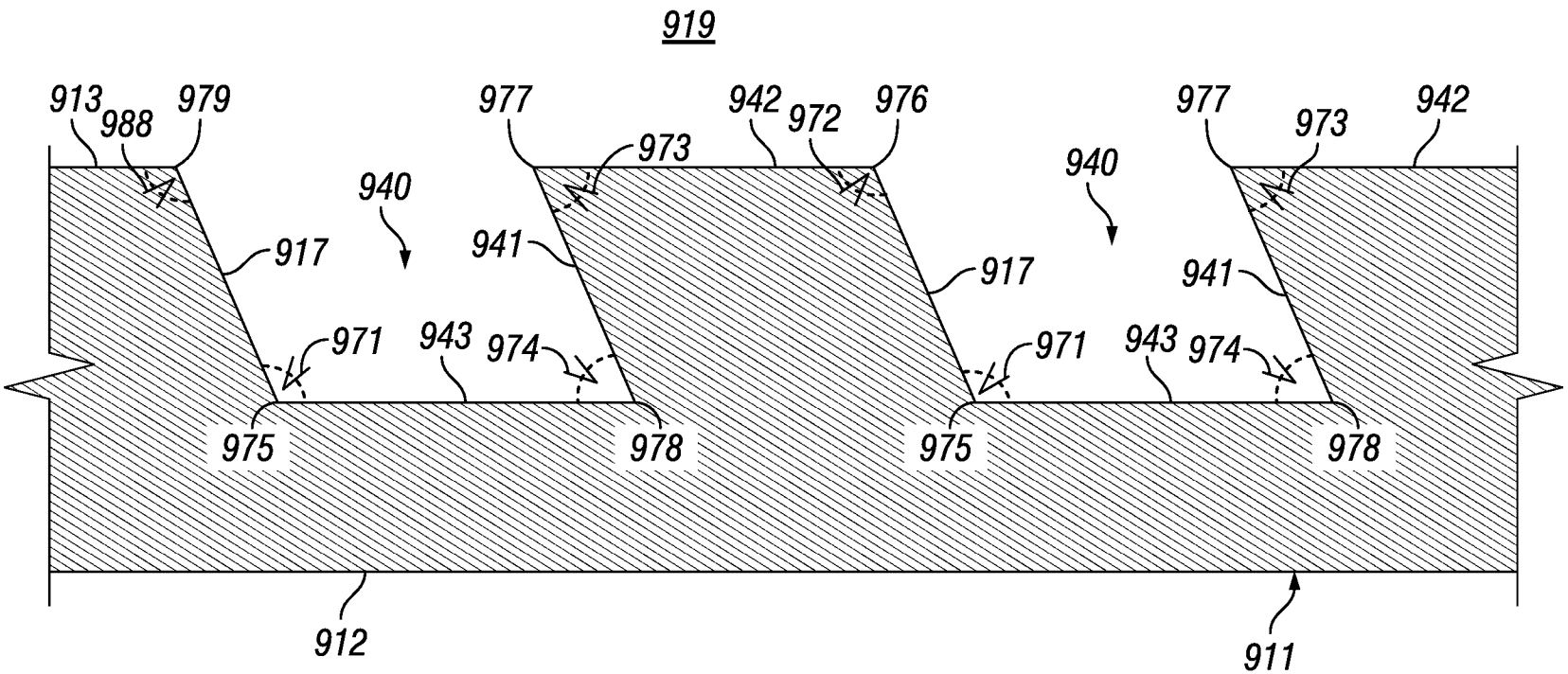

In certain example embodiments, the proximal wall 317 protrudes inward toward the cavity (e.g., cavity 319) of the shell (e.g., shell 311) from (relative to) the isolation zone inner surface 343 of the isolation zone 340. The proximal wall 317 and the isolation zone inner surface 343 can form an angle 371 relative to each other. For example, as shown in FIG. 3B, the angle 371 between the proximal wall 317 and the isolation zone inner surface 343 can be less (in this case, slightly less) than 90° (an acute angle). As another example, the angle 371 between the proximal wall 317 and the isolation zone inner surface 343 can be approximately 90° (substantially perpendicular or normal). As yet another alternative, as shown in FIGS. 8 and 9 below, the angle 371 between the proximal wall 317 and the isolation zone inner surface 343 can be more than 90° (an obtuse angle).

The proximal wall 317 of an isolation zone 340 can have any of a number of characteristics (e.g., shape, contour, features). For example, as shown in FIG. 3B, the proximal wall 317 can be planar with a smooth (e.g., untextured) surface. Further, the junction 375 between the proximal wall 317 and the isolation zone inner surface 343 can be rounded (as shown in FIG. 3B), squared, and/or have any other features. The proximal wall 317 can have any length and/or can protrude any distance inward (i.e., thickness) from the inner surface 313 toward the cavity 319.

The location of the distal end (i.e., the end furthest away from the isolation zone inner surface 343) of a proximal wall 317 of an isolation zone 340 can be closer to, substantially the same distance as, or further from the central axis that runs along the length of the cavity 319 (also called the center of the cavity 319) formed by the shell 311 of the electrical connector end 310 compared to the distance from the inner surface 313 to the center of the cavity 319 along the length of the shell 311. For example, as shown in FIG. 3B, the proximal wall 317 of the left-most isolation zone 340 forms a junction 379 with the inner surface 313 of the shell 311, and so the distal end of the proximal wall 317 and the inner surface 313 are approximately the same distance from the center of the cavity 319.

In such a case, the junction 379 between the proximal wall 317 of an isolation zone 340 and the inner surface 313 can be rounded (as shown in FIG. 3B), squared, and/or have any other features. Further, when the proximal wall 317 of an isolation zone 340 and the inner surface 313 form a junction 379, the proximal wall 317 and the inner surface 313 can form an angle 388 relative to each other. For example, as shown in FIG. 3B, the angle 388 between the proximal wall 317 and the inner surface 313 can be less (in this case, slightly less) than 90° (an acute angle). As another example, the angle 388 between the proximal wall 317 and the inner surface 313 can be approximately 90° (substantially perpendicular or normal). As yet another alternative, the angle 388 between the proximal wall 317 and the inner surface 313 can be more than 90° (an obtuse angle).

In certain example embodiments, the distal wall 341 protrudes inward toward the cavity (e.g., cavity 319) of the shell (e.g., shell 311) from (relative to) the isolation zone inner surface 343 of the isolation zone 340. The distal wall 341 and the isolation zone inner surface 343 can form an angle 374 relative to each other. For example, as shown in FIG. 3B, the angle 374 between the distal wall 341 and the isolation zone inner surface 343 can be approximately 90° (substantially perpendicular or normal). As another example, the angle 374 between the distal wall 341 and the isolation zone inner surface 343 can be less than 90° (an acute angle). As yet another alternative, as shown in FIG. 9 below, the angle 374 between the distal wall 341 and the isolation zone inner surface 343 can be more than 90° (an obtuse angle).

The distal wall 341 of an isolation zone 340 can have any of a number of characteristics (e.g., shape, contour, features). For example, as shown in FIG. 3B, the distal wall 341 can be planar with a smooth (e.g., untextured) surface. Further, the junction 378 between the distal wall 341 and the isolation zone inner surface 343 can be rounded (as shown in FIG. 3B), squared, and/or have any other features. The distal wall 341 can have any length and/or can protrude any distance inward (i.e., thickness) from the inner surface 313 toward the cavity 319.

The location of the distal end (i.e., the end furthest away from the isolation zone inner surface 343) of a distal wall 341 of an isolation zone 340 can be closer to, substantially the same distance as, or further from the central axis that runs along the length of the cavity 319 (also called the center of the cavity 319) formed by the shell 311 of the electrical connector end 310 compared to the distance from the inner surface 313 to the center of the cavity 319 along the length of the shell 311. For example, as shown in FIG. 3A, the distal wall 341 of the right-most isolation zone 340 forms a junction 370 with the inner surface 313 of the shell 311, and so the distal end of the distal wall 341 and the inner surface 313 are approximately the same distance from the center of the cavity 319.

In such a case, the junction 370 between the distal wall 341 of an isolation zone 340 and the inner surface 313 can be rounded, squared, and/or have any other features. Further, when the distal wall 341 of an isolation zone 340 and the inner surface 313 form a junction 370, the distal wall 341 and the inner surface 313 can form an angle 380 relative to each other. For example, the angle 380 between the distal wall 341 and the inner surface 313 can be less than 90° (an acute angle). As another example, the angle 380 between the distal wall 341 and the inner surface 313 can be approximately 90° (substantially perpendicular or normal). As yet another alternative, the angle 380 between the distal wall 341 and the inner surface 313 can be more than 90° (an obtuse angle).

The isolation zone inner surface 343 of an isolation zone 340 can have any of a number of characteristics (e.g., shape, contour, features). For example, as shown in FIG. 3B, each isolation zone inner surface 343 can be planar with a smooth (e.g., untextured) surface. When two isolation zones are adjacent to each other, there can be a transition surface 342 disposed between the proximal wall 317 of one isolation zone 340 and the distal wall 341 of the adjacent isolation zone 340. For example, as shown in FIGS. 3A and 3B, transition surface 342 forms a junction 377 with the distal wall 341 of one isolation zone 340 and a junction 376 with the proximal wall 317 of an adjacent isolation zone 340. In such a case, the junction 376 between transition surface 342 and the proximal wall 317 of an adjacent isolation zone 340 and/or the junction 377 between transition surface 342 and the distal wall 341 of an adjacent isolation zone 340 can be rounded, squared, and/or have any other features. A transition surface 342 can have any length.

Further, when a transition surface 342 and the proximal wall 317 of an isolation zone 340 form a junction 376, the transition surface 342 and the proximal wall 317 can form an angle 372 relative to each other. For example, as shown in FIG. 3B, the angle 372 between transition surface 342 and the proximal wall 317 can be less than 90° (an acute angle).

As another example, the angle 372 between the transition surface 342 and the proximal wall 317 can be approximately 90° (substantially perpendicular or normal). As yet another alternative, the angle 372 between the transition surface 342 and the proximal wall 317 can be more than 90° (an obtuse angle).

Similarly, when a transition surface 342 and the distal wall 341 of an adjacent isolation zone 340 form a junction 377, the transition surface 342 and the distal wall 341 of an adjacent isolation zone 340 can form an angle 373 relative to each other. For example, the angle 373 between transition surface 342 and the distal wall 341 can be less than 90° (an acute angle). As another example, as shown in FIG. 3B, the angle 373 between the transition surface 342 and the distal wall 341 can be approximately 90° (substantially perpendicular or normal). As yet another alternative, the angle 373 between the transition surface 342 and the distal wall 341 can be more than 90° (an obtuse angle). In some cases, if the transition surface 342 is planar with the inner surface 313 of the shell 311, the transition surface 342 can be called the inner surface 313. In addition, in some cases, angle 372 can be called angle 388 and junction 376 can be called junction 379, or vice versa. Similarly, angle 373 can be called angle 380 and junction 377 can be called junction 370, or vice versa.

In certain example embodiments, some or all of an isolation zone 340 can be integral with the inner surface 313 of the shell 311, so that various characteristics (e.g., recesses, protrusions) of the inner surface 313 of the shell 311 form some or all of an isolation zone 340. For example, as shown in FIGS. 3A and 3B, each isolation zone 340 is a recess that is carved, cut, etched, and/or otherwise formed in the wall 312 of the shell 311. In addition, or in the alternative, some or all of an isolation zone 340 can be formed by one or more separate pieces that are mechanically coupled, directly or indirectly, to the wall 312 of the shell 311 using one or more of a number of coupling methods, including but not limited to epoxy, compression fittings, fastening devices, mating threads, slots, and detents. Other embodiments of electrical connector ends with example embodiments are shown and discussed below with respect to FIGS. 5-7.

In certain example embodiments, the characteristics (e.g., dimensions, angles, contours) of an isolation zone 340 (or portions thereof) are determined based, at least in part, on a minimal shear stress that the electrical connector end 310 must experience without deformation in order to comply with one or more standards (e.g., ATEX 95). Shear stress directly proportional to the force applied to the electrical connector end 310 and indirectly proportional to the cross-sectional area that is parallel with the vector of the applied force. Thus, the characteristics of an isolation zone 340 (or portions thereof) can be based on the cross-sectional area required to maintain the shear stress below a certain level (e.g., below the shear strength of the material of the shell 311). Example embodiments can help the shell 311 to withstand a shear stress set forth in any applicable standard.

Similar considerations can apply with respect to one or more locations along the wall 312 of the shell 311 where an isolation zone 340 is disposed. For example, if a certain location along the length of the shell 311 is likely to experience excessive forces, then an isolation zone 340 can be placed at that location. Such considerations are important for an electrical connector end 310 to comply with a shear strength requirement of one or more standards, such as ATEX 95.

As an example of various dimensions of the electrical connector end 310, the inner surface 313 of the shell 311 can form a diameter of approximately three inches. Each isolation zone 340 can be embedded (e.g., carved, cut) into the body 312 of the shell 311. The length of each isolation zone inner surface 343 can be approximately 0.24 inches. The length of each transition surface 342 can be approximately 0.05 inches. The distance between an isolation zone inner surface 343 and the inner surface 313/transition surface 342 can be approximately 0.15 inches. Angle 371 and angle 372 can each be approximately 80°. Angle 373 and angle 374 can each be approximately 90°.

Figure 4:
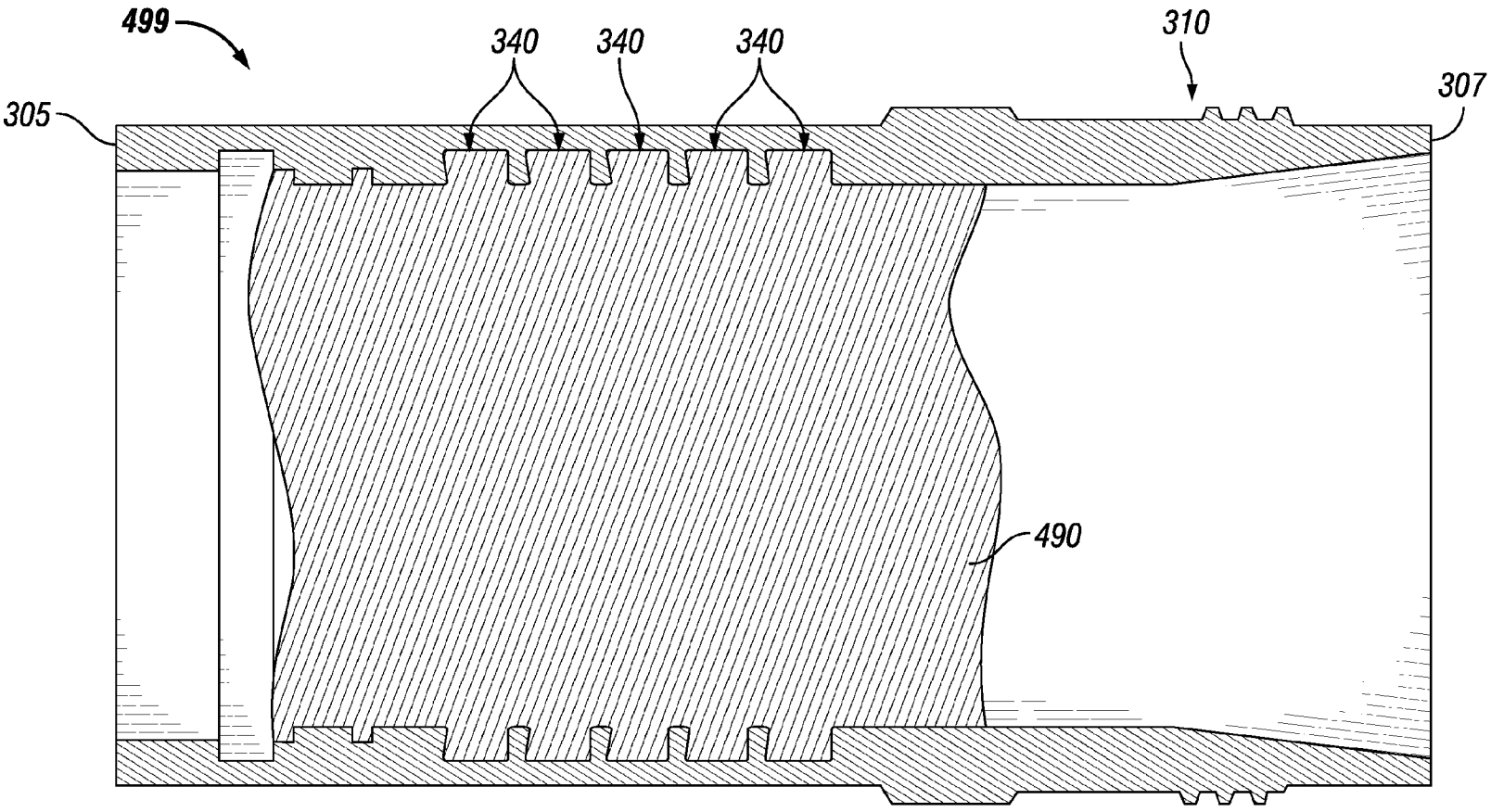
FIG. 4 shows an electrical connector end assembly in accordance with certain example embodiments.

FIG. 4 shows a cross-sectional side view of an electrical connector end assembly 499 in accordance with certain example embodiments. Specifically, the electrical connector end assembly 499 of FIG. 4 is the electrical connector end 310 of FIGS. 3A and 3B with potting compound 490 disposed within a portion of the cavity 319. Referring to FIGS. 1-4, Potting is a process of filling an electronic assembly (in this case, the cavity 319 and the isolation zones 340) with a solid or gelatinous compound (in this case, the potting compound 490) in order to provide resistance to shock and vibration, as well as for exclusion of moisture and corrosive agents. The potting compound 490 can include one or more of a number of materials, including but not limited to plastic, rubber, and silicone.

The potting compound 490 can be in one form (e.g., liquid) when it is inserted into the cavity 319 and the isolation zones 340 and, with time, transform into a different form (e.g., solid) while disposed inside the cavity 319 and the isolation zones 340. If the initial form of the potting compound 490 is liquid, the potting compound 490 has a number of characteristics, including but not limited to a viscosity and electrical conductivity. These characteristics can dictate the dimensions (e.g., length, width) of the isolation zones 340, including portions thereof that form an isolation zone 340. In addition, these characteristics can dictate whether an additional process (e.g., anodizing some or all of the shell 311) can be used to increase the effectiveness of the potting compound 490 (e.g., encourage covalent bonding).

In certain example embodiments, the potting compound 490 is used to prevent liquids (e.g., water) and/or gases from traveling from one end of the shell 311 to the other end of the shell 311, even at high pressure (e.g., 435 pounds per square inch (psi), 2000 psi, four times the maximum expected explosion pressure (based, at least in part, on the environment in which the electrical connector end 310 is disposed) of the shell 311 with the potting compound 490). In some cases, the electrical connector (of which the electrical connector end 310 is a part) can be certified under ATEX standards. For example, if a pressure that is four times the pressure required to rupture the shell 311 without the potting compound 490 is applied to the electrical connector end 310 with the potting compound 490 disposed in the cavity 319, and if no liquids leak during this test, then the potting compound 490 disposed in the shell 311 is gas-tight (e.g., flameproof) and meets the standards as being flameproof under ATEX/IECEx Standard 60079-1. In other words, the potting compound 490 can create a barrier that prevents flame propagation.

As the potting compound 490 changes from an initial (e.g., liquid) state to a final (e.g., solid) state, the potting compound 490 can experience shrinkage. For example, if the potting compound 490 cures from a liquid state to a solid state, the potting compound 490 can shrink by approximately 0.5%. This shrinkage can create gaps between the potting compound 490 and the inner surface 313 of the shell 311. Such gaps can allow fluids to seep therethrough, especially at higher pressures. Shrinkage and expansion of the potting compound 490 can also occur during normal operating conditions due to factors such as temperature and pressure. Specifically, the coefficient of thermal expansion of the potting compound 490 can differ from the coefficient of thermal expansion of the shell 311 inside of which the potting compound 490 is disposed.

As a result, the shrinkage in the potting compound 490 can cause actual gas leakage within the electrical connector, cause an electrical connector to fail a leakage test (also called a blotting test), cause an electrical connector to fail a shear stress test under the ATEX 95 standard, and/or create other issues that can affect the reliability of the electrical connector. As an example, if the diameter of the inner surface 313 of the shell 311 is approximately 2.5 inches, the total shrinkage of the potting compound 490 can be a total of approximately 0.0125 inches, which amounts to approximately 0.006 inches at any point along the inner surface 313 of the wall 312 of the shell 311. Especially at higher pressures, 0.006 inches can be a large enough gap to allow fluids and/or gases to pass along the length of the shell 311.

By integrating one or more example isolation zones 340 into the electrical connector end 310, the effects of the shrinkage of the potting compound 490 on a pressurized leakage test are greatly reduced. In addition, the various features (e.g., angle 371, junction 378, angle 372, junction 377) of an isolation zone 340 can help to prevent gases and/or liquids from leaking through the electrical connector end 310 (create a gas-tight and/or a liquid-tight seal). The specific angles (e.g., angle 371, angle 374) within an isolation zone 340 can be determined based, at least in part, on the coefficient of thermal expansion of the potting compound 490 and the coefficient of thermal expansion of the shell 311.

Figure 5:
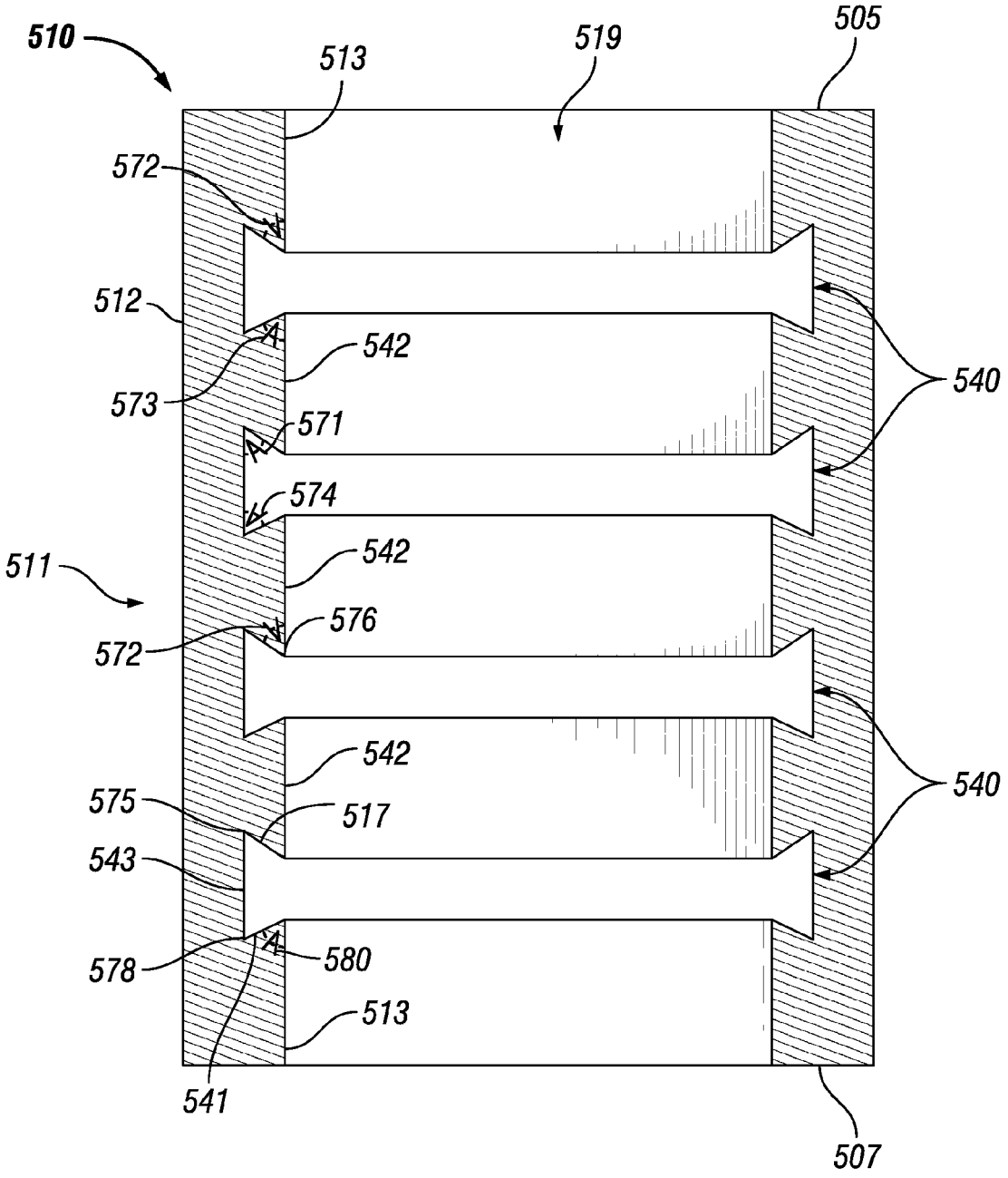
FIG. 5 shows another electrical connector end in accordance with certain example embodiments.

FIG. 5 shows another electrical connector end 510 in accordance with certain example embodiments. Referring to FIGS. 1-5, in this case, there are four isolation zones 540 cut into the wall 512 of the shell 511. Each isolation zone 540 of FIG. 5 has substantially similar characteristics (e.g., shape, size) relative to the other isolation zones 540. Each isolation zone 540 has a proximal wall 517 that forms angle 588 or angle 572 with the inner surface 513 of the shell 511 or a transition surface 542, respectively. (In this case, the inner surface 513 of the shell 511 is planar with each transition surface 542 between adjacent isolation zones 540.) The proximal wall 517 of each isolation zone also forms an angle 571 with the isolation zone inner surface 543 of that isolation zone 540.

Each isolation zone 540 also has a distal wall 541 that forms angle 573 or angle 580 with a transition surface 542 or the inner surface 513 of the shell 511, respectively. The distal wall 541 of each isolation zone also forms an angle 574 with the isolation zone inner surface 543 of that isolation zone 540. In this case, each of the angles (e.g., angle 588, angle 573, angle 571, angle 574) of the various isolation zones 540 is acute.

Figure 6:
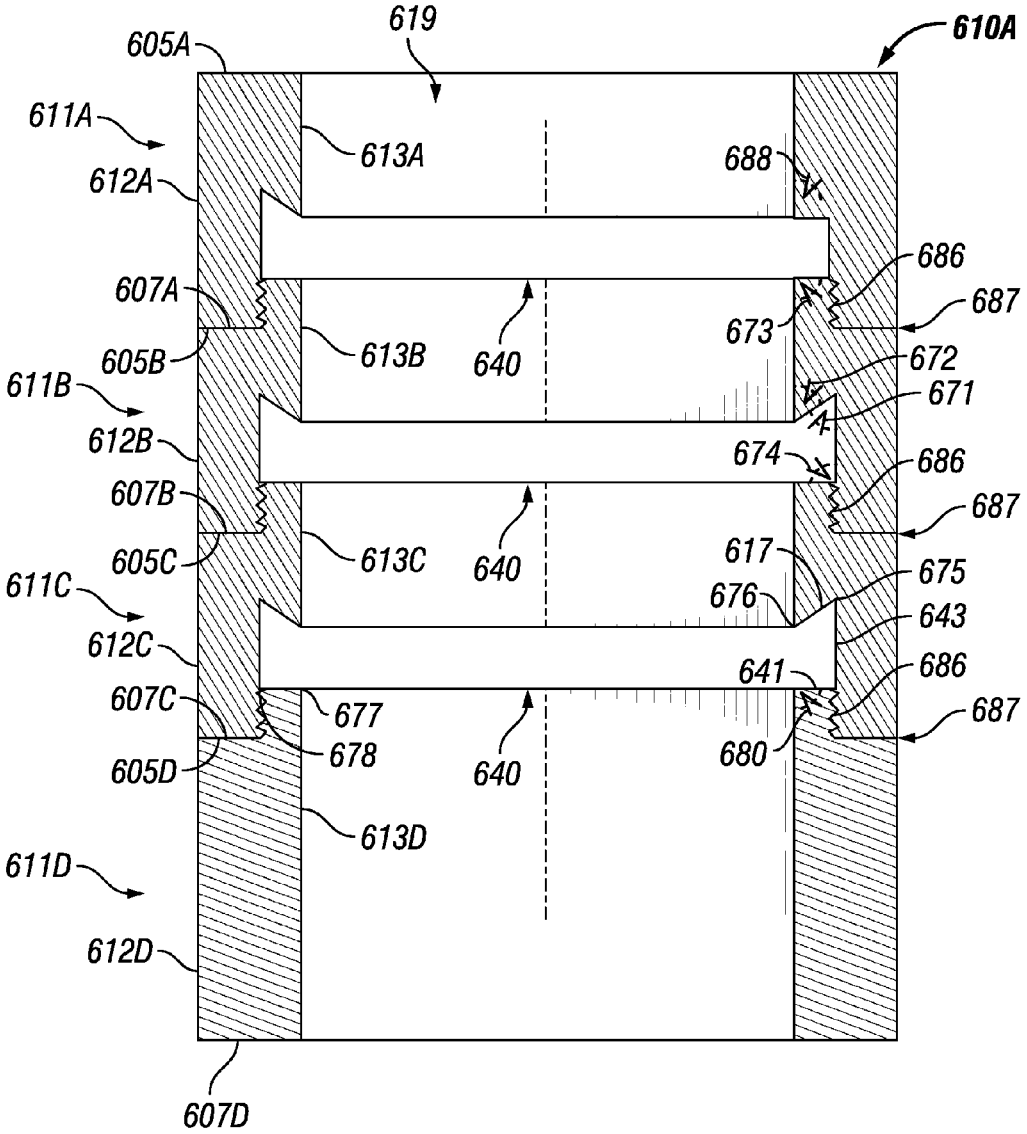
FIG. 6 shows yet another electrical connector end in accordance with certain example embodiments.

FIG. 6 shows yet another electrical connector end 610 in accordance with certain example embodiments. Specifically, electrical connector end 610 shows an example of how the shell can be in multiple pieces that are mechanically coupled to each other, in the process forming one or more isolation zones. Referring to FIGS. 1-6, in this case, the shell 610 of the electrical connector end 610 is made up of four pieces (shell 611A, shell 611B, shell 611C, and shell 611D) to form three isolation zones 640. Each of the shell pieces are stackable, elongating the electrical connector end 610 as one shell piece is coupled to another shell piece. One isolation zone 640 is formed where shell 611A is coupled to shell 611B. Another isolation zone 640 is formed where shell 611B is coupled to shell 611C. The final isolation zone 640 is formed where shell 611C is coupled to shell 611D.

Each shell piece can include one more of a number of coupling features that allow that shell piece to couple to an adjacent shell piece. In this case, the coupling feature is mating threads 686. Further, a flame path 687 results where each shell piece is coupled to an adjacent shell piece based on the configuration of the shell pieces. Consequently, the mating threads 686 must be specifically engineered so that the electrical connector end 610 complies with applicable industry standards.

Each isolation zone 640 of FIG. 6 has substantially similar characteristics (e.g., shape, size) relative to the other isolation zones 640. Each isolation zone 640 has a proximal wall 617 that forms angle 688 or angle 672 with the inner surface 613 of the shell 611 or a transition surface 642, respectively. (In this case, the inner surface 613 of the shell 611 is planar with each transition surface 642 between adjacent isolation zones 640.) The proximal wall 617 of each isolation zone also forms an angle 671 with the isolation zone inner surface 643 of that isolation zone 640.

Each isolation zone 640 also has a distal wall 641 that forms angle 673 or angle 680 with a transition surface 642 or the inner surface 613 of the shell 611, respectively. The distal wall 641 of each isolation zone also forms an angle 674 with the isolation zone inner surface 643 of that isolation zone 640. In this case, angle 680 and each angle 673 is approximately 90°, while the remaining angles (e.g., angle 673, angle 671, angle 674) of the various isolation zones 640 are acute.

Figure 7:
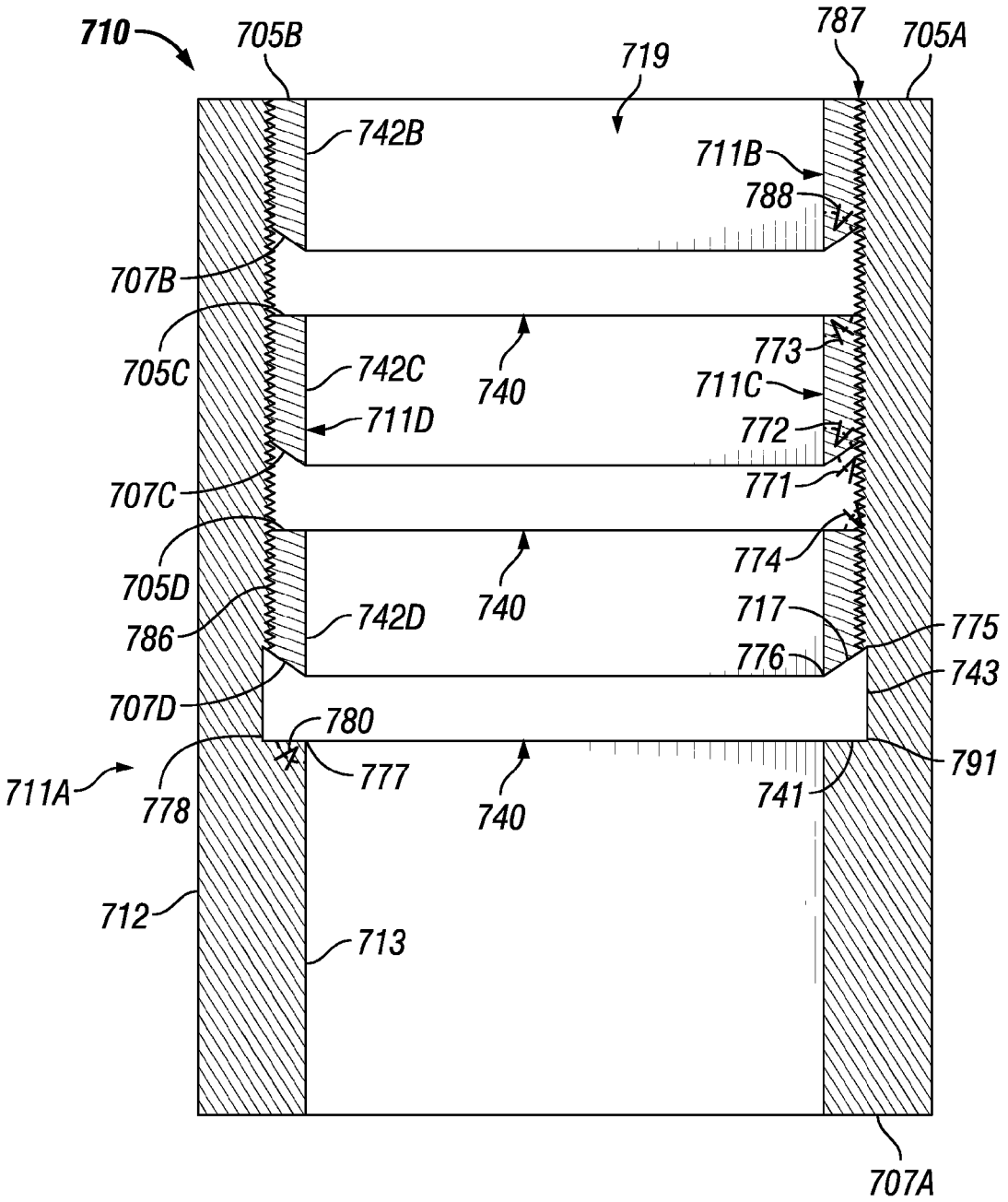
FIG. 7 shows still another electrical connector end in accordance with certain example embodiments.

FIG. 7 shows still another electrical connector end 710 in accordance with certain example embodiments. Specifically, electrical connector end 710 shows another example of how the shell can be in multiple pieces that are mechanically coupled to each other, in the process forming one or more isolation zones. Referring to FIGS. 1-7, the shell 710 of the electrical connector end 710 is made up of four pieces (shell 711A, shell 711B, shell 711C, and shell 711D) to form three isolation zones 740. In this case, shell 710A has an internal coupling feature 786 (in this case, mating threads) that couple to a complementary coupling feature 786 of each of shell 711B, shell 711C, and shell 711D.

One isolation zone 740 is formed where shell 711D is coupled to shell 711A. Another isolation zone 740 is formed between shell 711A, shell 711C, and shell 711D when shell 711C is coupled to shell 711A. The final isolation zone 640 is formed between shell 711A, shell 711B, and shell 711C when shell 711B is coupled to shell 711A. Further, a flame path 787 results where each shell 711B is coupled to shell 711A. Consequently, the mating threads 786 (or other form of coupling feature) used to couple shell 711B to shell 711A must be specifically engineered so that the electrical connector end 710 complies with applicable industry standards.

Each isolation zone 740 of FIG. 7 has substantially similar characteristics (e.g., shape, size) relative to the other isolation zones 740. Each isolation zone 740 has a proximal wall 717 (formed by end 707 of the adjacent shell piece) that forms angle 788 or angle 772 with the inner surface 713 of the shell 711 or a transition surface 742 (formed by the inner surface of the adjacent shell piece), respectively. (In this case, the inner surface 713 of the shell 711 is planar with each transition surface 742 between adjacent isolation zones 740.) The proximal wall 717 of each isolation zone also forms an angle 771 with the isolation zone inner surface 743

(formed by the mating threads 786 of the shell 711A or an extended surface where such mating threads 786 end) of that isolation zone 740.

Each isolation zone 740 also has a distal wall 741 (formed by end 705C of shell 711C, end 705D of shell 711D, or surface 791 of shell 711A) that forms angle 773 or angle 780 with a transition surface 742 or the inner surface 713, as appropriate. The distal wall 741 of each isolation zone 740 also forms an angle 774 with the isolation zone inner surface 743 of that isolation zone 740. In this case, angle 780 and each angle 773 is approximately 90°, while the remaining angles (e.g., angle 773, angle 771, angle 774) of the various isolation zones 740 are acute.

FIGS. 8 and 9 show detailed views, similar to FIG. 3B above, of various isolation zones of electrical connector ends in accordance with certain example embodiments. Referring to FIGS. 1-9, FIG. 8 shows isolation zones 840 where the angle 871 formed by the proximal wall 817 and the isolation zone inner surface 843 is an acute angle, and the angle 874 formed by the distal wall 841 and the isolation zone inner surface 843 is an obtuse angle. Further, the junction 878 between the distal wall 841 and the isolation zone inner surface 843, as well as the junction 878 between the proximal wall 817 and the isolation zone inner surface 843, are rounded.

In addition, the angle 888 formed by the proximal wall 817 and the inner surface 813 of the shell 811 is an acute angle, and the junction between the proximal wall 817 and the inner surface 813 of the shell 811 is rounded. Further, the angle 872 formed by the proximal wall 817 and transition surface 842 is an acute angle, and the angle 873 formed by the distal wall 841 and the transition surface 842 is an obtuse angle. Also, the junction 877 between the distal wall 841 and the transition surface 842, as well as the junction 876 between the proximal wall 817 and the transition surface 842, are rounded.

As stated above, one or more of the junctions (e.g., junction 877) in this example can have any of a number of other characteristics (e.g., pointed) aside from being rounded. Further one or more of the angles (e.g., angle 871) in this example can be any angle (e.g., acute, obtuse, normal) other than what is shown and described in this FIG. 8.

FIG. 9 shows isolation zones 940 where the angle 971 formed by the proximal wall 917 and the isolation zone inner surface 943 is an obtuse angle, and the angle 974 formed by the distal wall 941 and the isolation zone inner surface 943 is an acute angle. Further, the junction 978 between the distal wall 941 and the isolation zone inner surface 943, as well as the junction 978 between the proximal wall 917 and the isolation zone inner surface 943, are pointed.

In addition, the angle 988 formed by the proximal wall 917 and the inner surface 913 of the shell 911 is an obtuse angle, and the junction between the proximal wall 917 and the inner surface 913 of the shell 911 is pointed. Further, the angle 972 formed by the proximal wall 917 and transition surface 942 is an obtuse angle, and the angle 973 formed by the distal wall 941 and the transition surface 942 is an acute angle. Also, the junction 977 between the distal wall 941 and the transition surface 942, as well as the junction 976 between the proximal wall 917 and the transition surface 942, are pointed.

The systems and methods described herein allow an electrical chamber to be used in hazardous environments and potentially explosive environments. Specifically, example embodiments allow electrical chambers (e.g., electrical connector ends, junction boxes, light fixtures) to comply with one or more standards (e.g., ATEX 95) that apply to electrical devices located in such environments. Example embodiments also allow for reduced manufacturing time and costs of electrical chambers. Example embodiments also provide for increased reliability of electrical equipment that is electrically coupled to electrical chambers. Example embodiments can include a wedging feature (the portions of the isolation zone that are formed by and/or within the shell) that take advantage of the difference in coefficients of thermal expansion between the shell material (e.g., metal) and the potting compound. Specifically, the potting compound is wedged tightly into the isolation zone as temperatures decrease, while also allowing material creep to occur as temperatures increase.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An electrical connector end, comprising:

at least one wall forming a cavity, wherein the at least one wall comprises a first end and a wall inner surface; and a first isolation zone disposed on the wall inner surface at a first distance from the first end along an inner perimeter of the wall inner surface, wherein the first isolation zone is formed by a first proximal wall, a first distal wall, and a first isolation zone inner surface disposed between and adjacent to the first proximal wall and the first distal wall, wherein the first proximal wall forms a first angle with the first isolation zone inner surface, wherein the first distal wall forms a second angle with the first isolation zone inner surface, wherein the first angle is non-perpendicular, wherein the cavity is configured to receive at least one electrical conductor, and wherein the cavity and the first isolation zone are configured to receive a potting compound, wherein the first isolation zone is not configured to receive another electrical connector end, and wherein the first isolation zone forms a continuous ring around the wall inner surface at the first distance from the first end along the circumference of the wall inner surface.

2. The electrical connector end of claim 1, wherein the first proximal wall forms a third angle with the wall inner surface of the at least one wall, and wherein the distal wall forms a fourth angle with the wall inner surface of the at least one wall.

3. The electrical connector end of claim 1, wherein the first isolation zone inner surface is substantially parallel to the wall inner surface.

4. The electrical connector end of claim 1, wherein the first isolation zone inner surface is recessed into the at least one wall relative to the wall inner surface.

5. The electrical connector end of claim 1, wherein the first angle is acute.

6. The electrical connector end of claim 5, wherein the second angle is acute.

7. The electrical connector end of claim 5, wherein the second angle is obtuse.

8. The electrical connector end of claim 1, wherein the first angle is obtuse.

9. The electrical connector end of claim 1, further comprising:

a second isolation zone disposed on the wall inner surface at a second distance from the first end, wherein the second isolation zone is formed by a second distal wall, a second proximal wall, and a second isolation zone inner surface disposed between and adjacent to the second distal wall and the second proximal wall.

10. The electrical connector end of claim 9, wherein the second proximal wall and the first distal wall are disposed on opposite sides of and adjacent to a first transition surface.

11. The electrical connector end of claim 10, wherein the first transition surface is part of the wall inner surface of the at least one wall.

12. The electrical connector end of claim 10, wherein the first transition surface and the first distal wall meet at a rounded joint.

13. The electrical connector end of claim 9, wherein the second distance is greater than the first distance.

14. The electrical connector end of claim 1, wherein the at least one wall portion comprises a first wall portion and a second wall portion, wherein the first wall portion is coupled to the second wall portion, wherein the first wall portion and the second wall portion, when coupled to each other, form the first isolation zone.

15. The electrical connector end of claim 14, wherein the first wall portion and the second wall portion are coupled to each other using mating threads.

16. The electrical connector end of claim 14, wherein the first wall portion and the second wall portion, when coupled to each other, form a flame path therebetween.

17. The electrical connector end of claim 14, wherein the at least one wall portion further comprises a third wall portion, wherein the first wall portion is coupled to the third wall portion, wherein the first wall portion and the third wall portion, when coupled to each other, form a second isolation zone.

18. The electrical connector end of claim 17, wherein the second isolation zone comprises a second isolation zone inner surface disposed between and adjacent to a second distal wall and a second proximal wall, wherein the second proximal wall forms a third angle with the second isolation zone inner surface, wherein the second distal wall forms a fourth angle with the second isolation zone inner surface, wherein the third angle is non-perpendicular, and wherein the third angle differs from the first angle of the first isolation zone.

19. The electrical connector end of claim 17, wherein decoupling the second wall portion from the first wall portion results in a third isolation zone, wherein the third isolation zone is formed by the first wall portion and the third wall portion.

20. An electrical connector assembly, comprising:

an electrical connector end, comprising:

at least one wall forming a cavity, wherein the at least one wall comprises a first end and a wall inner surface; and a first isolation zone disposed on the wall inner surface at a first distance from the first end along an inner perimeter of the wall inner surface, wherein the first isolation zone is formed by a first proximal wall, a first distal wall, and a first isolation zone inner surface disposed in between and adjacent to the first proximal wall and the first distal wall, wherein the first proximal wall forms a first angle with the first isolation zone inner surface, wherein the first distal wall forms a second angle with the first isolation zone inner surface, wherein the first angle is non-perpendicular;

at least one electrical conductor disposed within the cavity; and a potting compound disposed around the at least one conductor within the cavity and the first isolation zone, wherein the first isolation zone does not receive another electrical connector end.

* * * * *